US005692664A

United States Patent [19]

Vettoretti et al.

[11] Patent Number: 5,692,664

[45] Date of Patent: Dec. 2, 1997

[54] ANCHOR FIXING APPARATUS

[75] Inventors: Alain Vettoretti, Valence; Patrick Herelier, St. Jean De Muzols, both of France

[73] Assignee: Societe de Prospection et d'Inventions Techniques (S.P.I.T.), Bourg les Valence, France

[21] Appl. No.: 417,170

[22] Filed: Apr. 5, 1995

[30] Foreign Application Priority Data

Apr. 20, 1994 [FR] France ..... 94 04721

[51] Int. Cl.[6] ..... B25B 23/04; B25C 1/00

[52] U.S. Cl. ..... 227/10; 227/119; 227/120; 227/139

[58] Field of Search ..... 227/114, 115, 227/116, 119, 120, 135, 138, 139, 8, 9, 10

[56] References Cited

U.S. PATENT DOCUMENTS

| | | | |
|---|---|---|---|
| 4,657,167 | 4/1987 | Mays | 227/114 |
| 4,699,306 | 10/1987 | Smith, Jr. | 227/120 |
| 4,765,057 | 8/1988 | Muller | 227/120 |
| 5,042,142 | 8/1991 | Beach et al. | 227/120 |
| 5,193,729 | 3/1993 | Dewey et al. | 227/9 |
| 5,199,506 | 4/1993 | Dewey et al. | 227/119 |
| 5,199,625 | 4/1993 | Dewey et al. | 227/8 |

FOREIGN PATENT DOCUMENTS 0535826 4/1993 European Pat. Off. .

*Primary Examiner*—Joseph J. Hail, III
*Assistant Examiner*—Jay A. Stelacone
*Attorney, Agent, or Firm*—Schwartz & Weinrieb

[57] ABSTRACT

The indirect-firing apparatus includes a combustion chamber for a cartridge (62), a trigger for igniting the cartridge, a barrel, an inertia block in the barrel, an anchor guide (7) designed to receive an anchor, a shuttle (34) in the anchor guide (7) mounted for movement from an anchor loading position to a position for firing and driving of the anchor, mechanisms (63, 11, 46) for displacement of the shuttle from one position to the other, and a barrel holder (61) for concomitantly controlling the closure of the combustion chamber (3) and means for displacement of the shuttle (34). The mechanisms (63, 11, 46) for displacement of the shuttle (34) are arranged so as to drive the shuttle (34) beyond the firing position (25). Damping components (33, 38), when the shuttle (34) has reached its firing position (25), absorb the action of the displacement mechanisms (63, 11, 46).

20 Claims, 6 Drawing Sheets

ANCHOR FIXING APPARATUS

FIELD OF THE INVENTION

The present invention concerns an indirect-firing fixing apparatus designed to be used by an operator in a standing position, including a combustion chamber designed to receive a powder cartridge, means for igniting the powder of the cartridge, a barrel, an inertia block in the barrel designed to be driven by the combustion gases of the powder, an anchor guide designed to receive an anchor to be driven by the inertia block into a substrate material, a shuttle in the anchor guide mounted for movement from an anchor loading position to a position for firing and driving of the anchor by the inertia block, means for displacement of the shuttle from one position to the other, and means for concomitantly controlling a means for closing the combustion chamber and the means for displacement of the shuttle.

BACKGROUND OF THE INVENTION

Apparatus of the foregoing type is used for example to fix steel plates to metal or concrete supporting structures in order to mount roofs or ceilings.

Such an apparatus is already known. It is described in particular in EP-A-0 535 826.

An anchor including a shank, a head end with which the inertia block is designed to cooperate, and a centering washer of the same section as the head mounted on the shank between the head and its penetrating end, is generally used as the anchor.

Closure of the combustion chamber and arrival of the shuttle in the firing position should also be concomitant.

But wear of the components after a certain number of operating cycles and, even when new, the manufacturing tolerances create a risk that, at the moment of firing, the shuttle will not be correctly positioned and therefore the anchor will not be located precisely along the axis of the anchor guide and barrel.

In this case, driving of the anchor by the inertia block would cause the head or washer of the anchor to catch on the rim of the bore of the anchor guide behind the shuttle, and would destroy the anchor.

The present invention aims to eliminate such a risk.

SUMMARY OF THE INVENTION

For this purpose, the present invention concerns an apparatus of the above-mentioned type, characterised in that the means for displacement of the shuttle is arranged so as to drive the shuttle beyond the firing position, and damping means are provided for absorbing the action of the displacement means of the shuttle when the shuttle has reached its firing position.

The invention therefore provides, at the end of the action of the means for controlling the means for closing the combustion chamber and the means for displacement of the shuttle, means for dissociating the displacement of the shuttle from the closure of the chamber. When the shuttle comes into abutment with means of the apparatus defining the firing position, normally, the combustion chamber is not yet completely closed; the continuation of the actuation of the means for displacement of the shuttle, with that of the means for closing the combustion chamber, by the control means, is therefore absorbed by the damping means. In the case of maximum wear, it may be possible that the damping means no longer performs any function.

In other words, the invention provides for supplementary travel or displacement, or "overtravel," of the shuttle, during which it is therefore never driven, and which makes it possible to compensate for manufacturing tolerances and clearances caused by wear of the components which is anticipated.

In the preferred embodiment of the apparatus of the invention, the means for displacement of the shuttle includes a driving slide mounted for movement in the shuttle against the action of return damping means, the slide being displaced in the shuttle as soon as it has come into abutment with the means of the apparatus defining the firing position, the damping means thus being arranged at the end of a kinetic chain of displacement of the shuttle.

The damping means could also be provided at the beginning of the chain.

Other damping means could be imagined such as, for example, a damping spring which is actually within the kinetic chain of displacement of the shuttle.

BRIEF DESCRIPTION OF THE DRAWINGS

Various other objects, features, and attendant advantages of the present invention will be understood better with the aid of the description below of the preferred embodiment of the apparatus of the invention, and with reference to the attached drawings in which like reference characters designate like or corresponding parts throughout the several views, and wherein.

DETAILED DESCRIPTION OF THE PREFERRED EMBODIMENT

Figure 1:
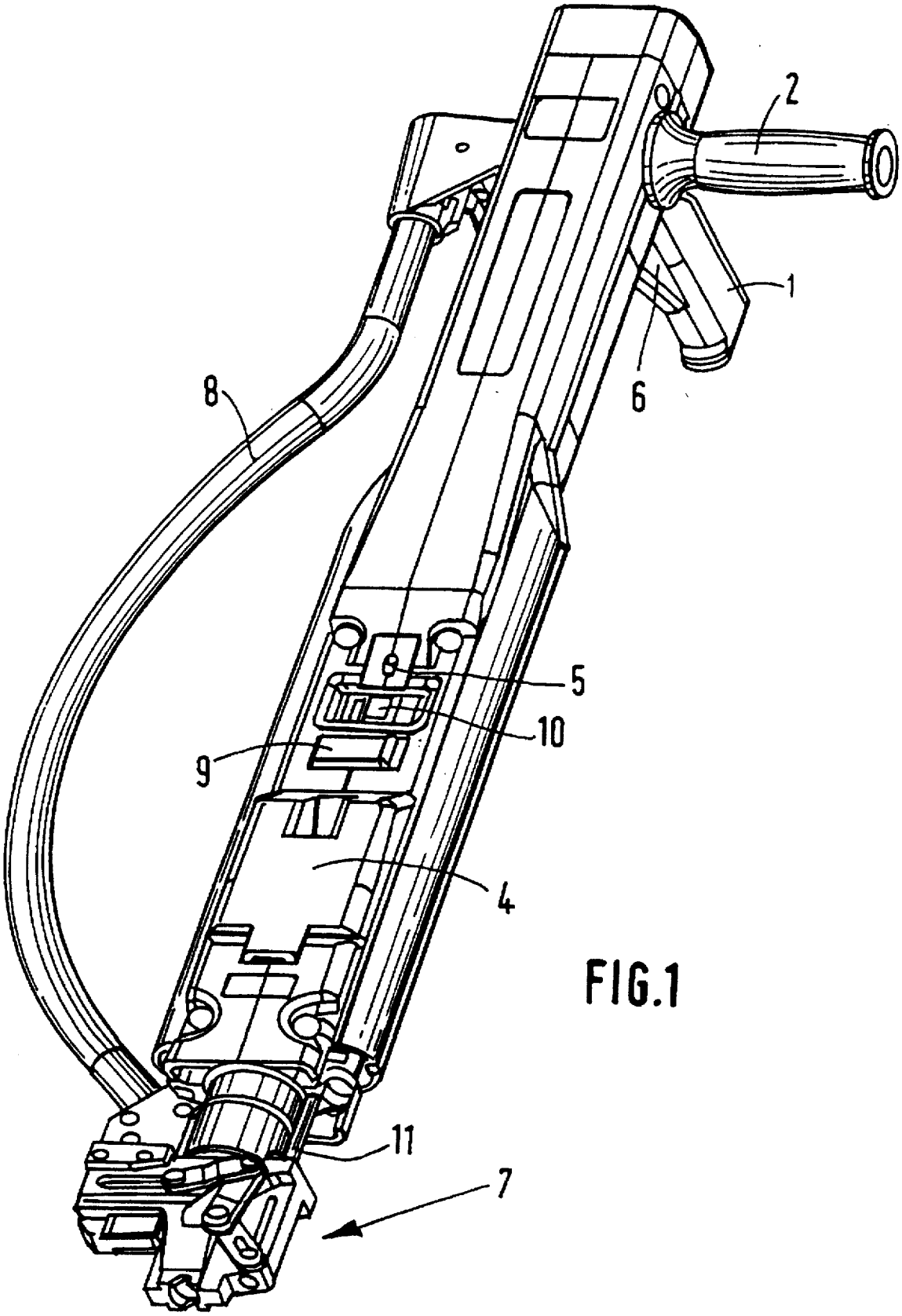
FIG. 1 is a front-side perspective view of the apparatus of the invention.
Figure 2:
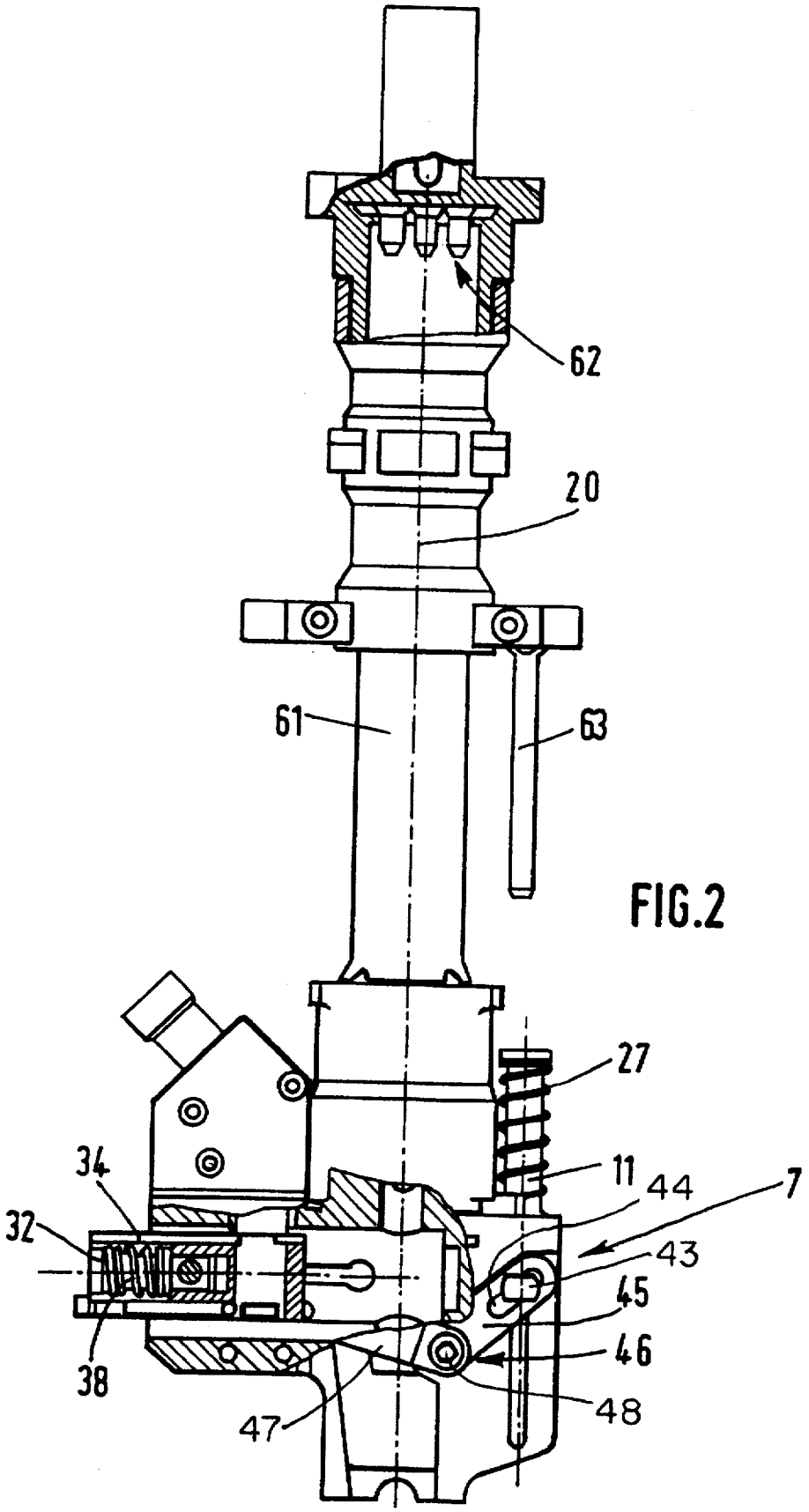
FIG. 2 is an elevation view, partly in section, of the barrel holder, the barrel, and the anchor guide of the apparatus of FIG. 1, in the rest position.

With reference to FIG. 1, the apparatus comprises a rear handle 1 and a side handle 2, a combustion chamber 3 with its cap 4, its cap opening pusher 9, its wheel 10 and its power adjusting slider 5, a trigger 6, an anchor guide 7, an anchor feed tube 8, and a shuttle displacement rod 11.

Figure 3:
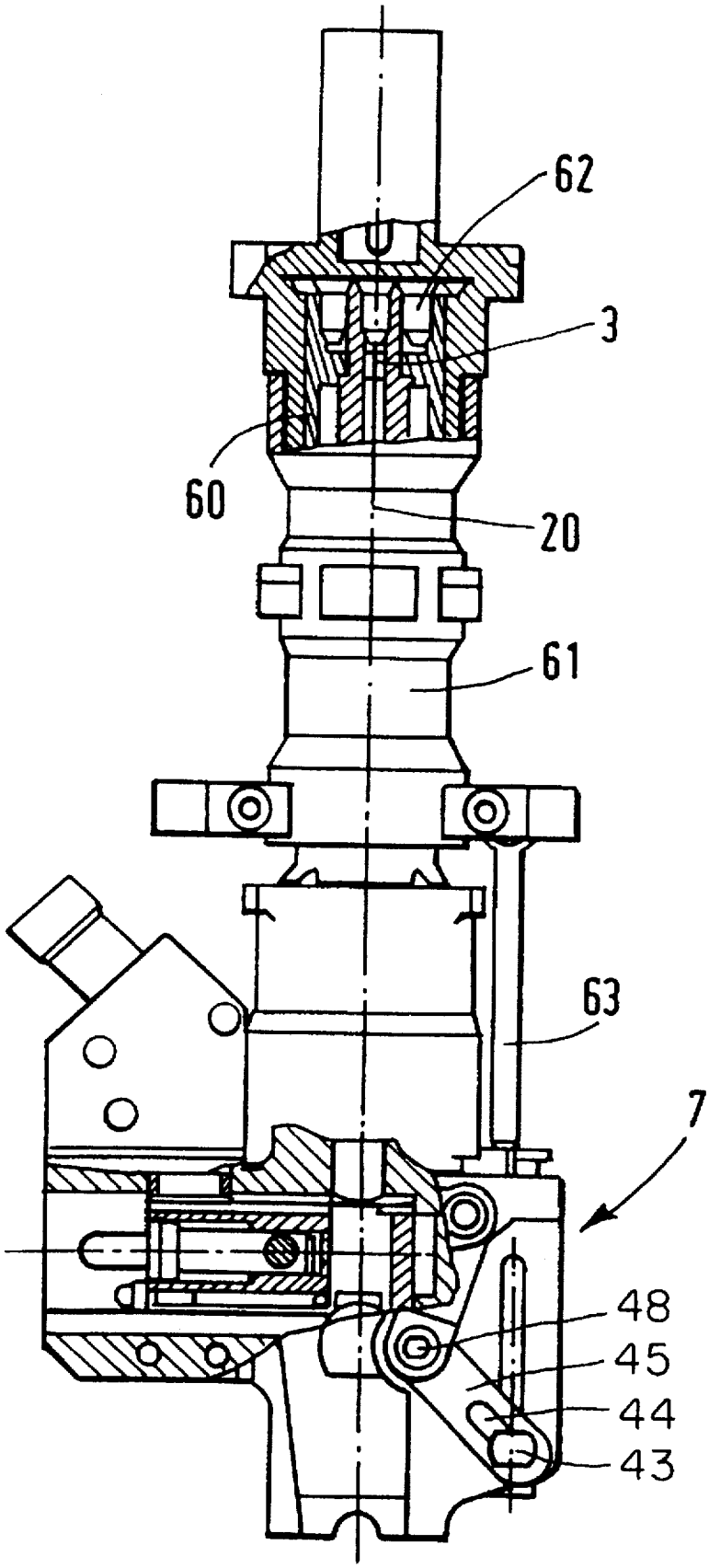
FIG. 3 is a view similar to that of FIG. 2 and showing the components of FIG. 2 in the firing position.

The combustion chamber 3 is formed at the rear of the barrel 60, to the front end of which the anchor guide 7 is rigidly connected, as best seen in FIG. 3. The barrel 60 is slidably mounted in a barrel holder 61 designed to receive, before closure of the cap 4, a disc of cartridges 62 one of which is designed to be covered by the barrel 60 in the position of firing and closure of the combustion chamber 3. The barrel holder 61, having an axis 20, carries a finger 63 for control of the displacement of an anchor loading shuttle. The finger 63 extends, on the side of the barrel holder 61, parallel to the axis 20.

The apparatus is an apparatus for firing while standing up. The fixing anchors are introduced into the tube 8. To put the apparatus in the firing position, the operator closes the combustion chamber 3 and places an anchor in the anchor guide 7, along the axis of the barrel and inertia block, and then the operator, by the handles 1, 2 contacts the apparatus upon the substrate material designed to receive the anchor and bears on the apparatus in order, against the action of springs, to lower the barrel holder 61 towards the anchor guide 7. During application, the rear of the barrel 60 covers a cartridge and recloses the chamber 3, and the finger 63 descends to actuate the rod 11. Ignition takes place by the trigger 6. To rearm the apparatus and actuate the catch for return of the inertia block to the firing position, the operator removes the apparatus from its point of application upon the substrate.

Figure 4:
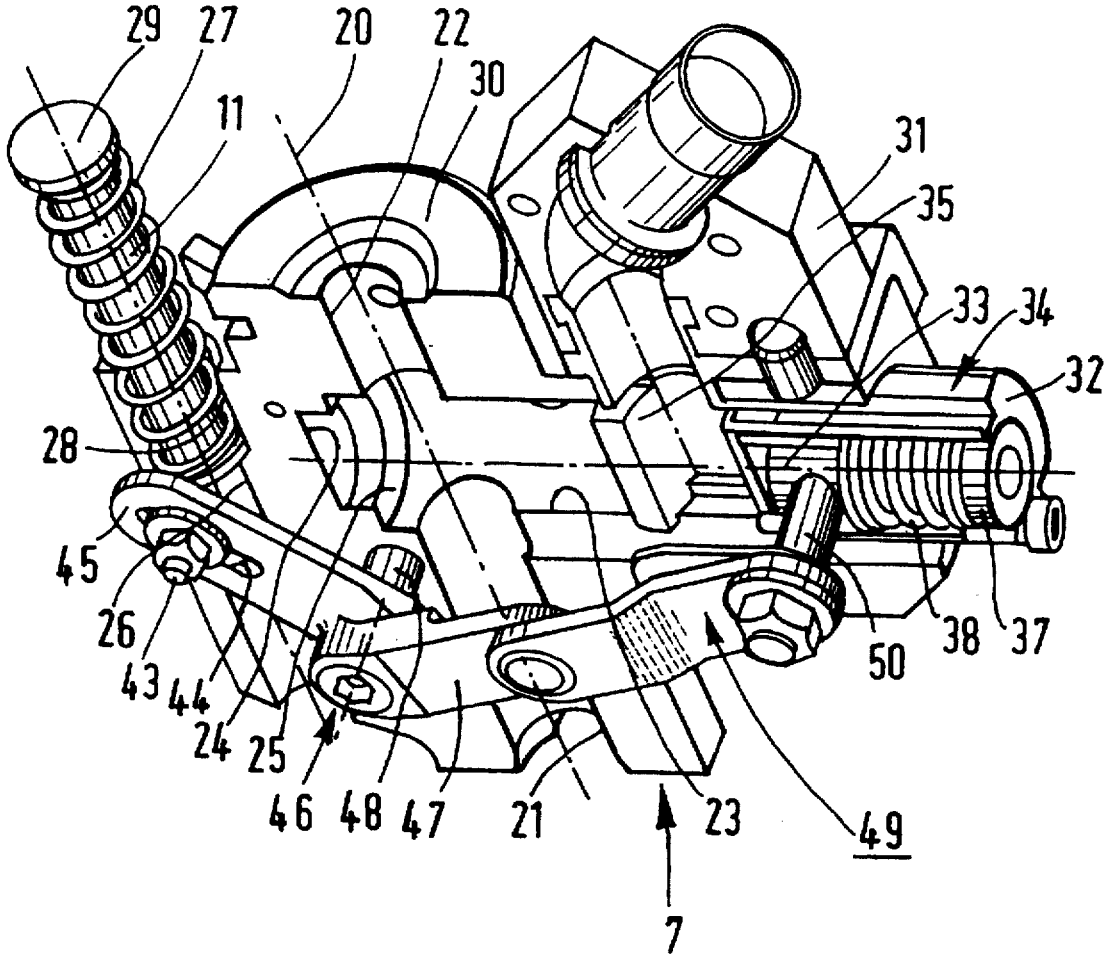
FIG. 4 is an inverted perspective view of the anchor guide of the apparatus, in the anchor loading position.
Figure 5:
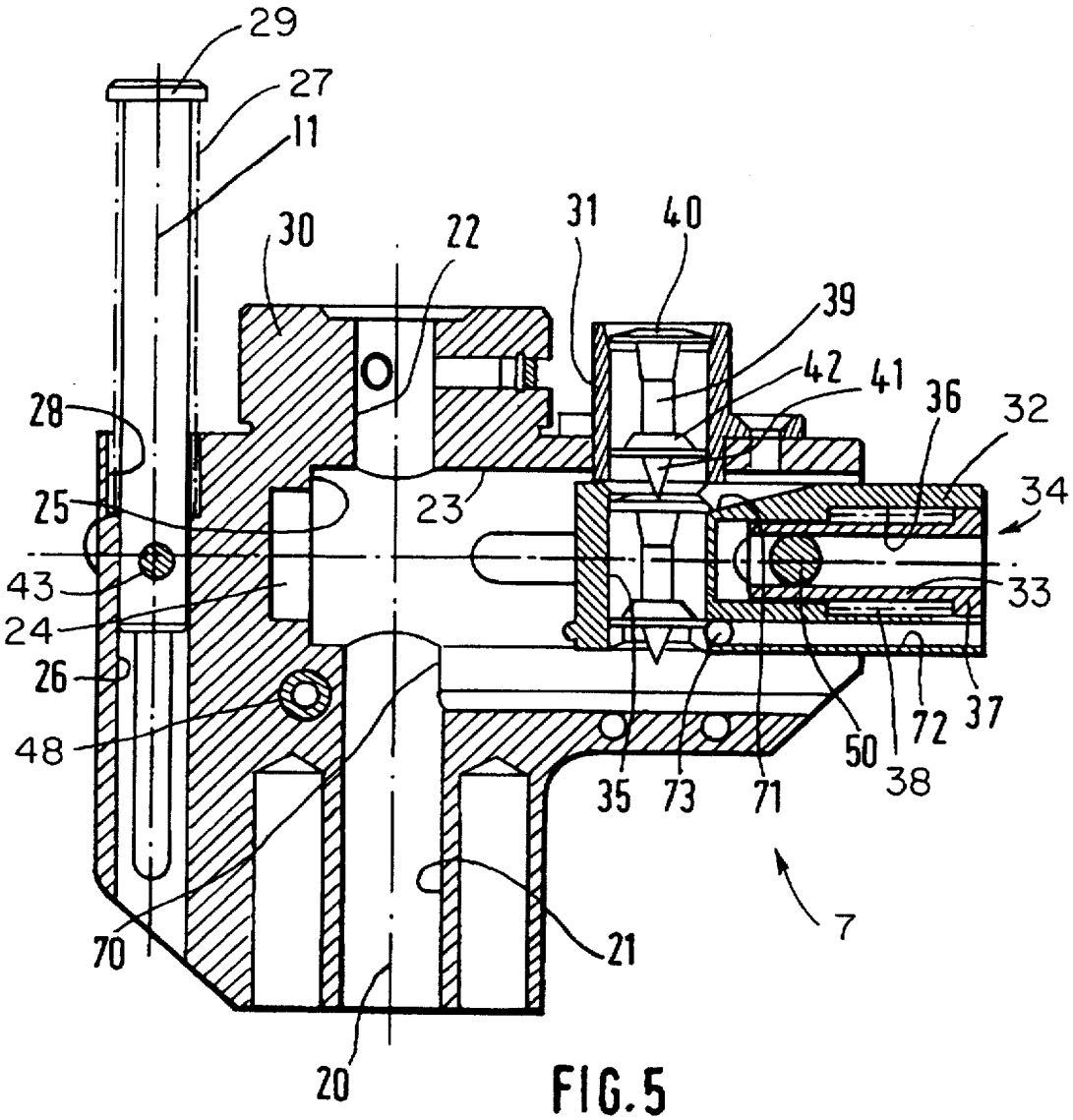
FIG. 5 is an axial cross-sectional view of the anchor guide of FIG. 4.
Figure 6:
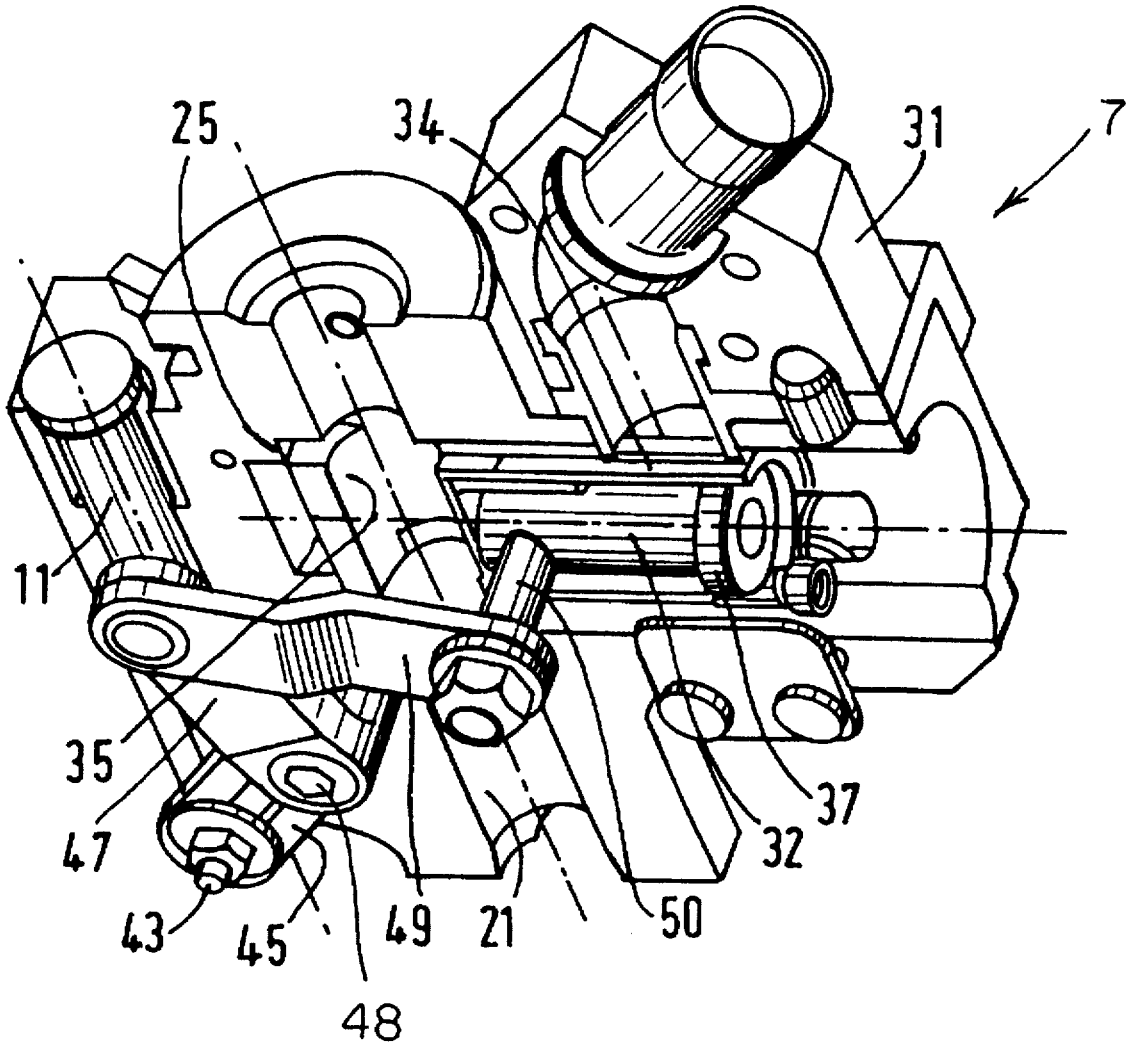
FIG. 6 is a perspective view of the anchor guide similar to that of FIG. 4, but in the firing position.

The anchor guide 7 essentially comprises three bores as best seen in FIGS. 4 and 5. A first central, longitudinal through-bore, with an end portion 21 having a cross-section corresponding to that of the anchors, and an inner portion 22 having a constricted cross-section corresponding to that of the inertia block, extends along the axis 20 of the barrel of the apparatus. A second transverse, blind bore 23 orthogonal to the longitudinal bore 21, 22 houses an anchor receiving shuttle 34. These two bores are secant, the shuttle bore 23 comprising close to its bottom 24 an annular shuttle stop shoulder 25. A third through-bore 26 extends, on the side of the anchor guide, parallel to the central bore 21, 22. It houses the shuttle displacement rod 11. As the latter is itself displaced against the action of a compression spring 27, the bore 26 comprises a wider portion 28, for housing this spring 27, which extends between the shoulder formed between the two bore portions 26, 28 and the head 29 of the rod 11.

Between the inner end 30 of the anchor guide, through which extends the central bore portion 22 of constricted section, and the mouth of the transverse bore 23 through which the shuttle 34 is mounted, the anchor guide comprises an opening for the passage of an anchor, around which is fixed the end piece 31 of the feed tube 8.

The shuttle 34, shaped to slide in the bore 23, essentially comprises two sleeves juxtaposed and orthogonal to each other. A first outer sleeve 32, which receives a displacement slide 33, and the bore 23 are coaxial. A second inner sleeve 35 has an axis parallel to the axis 20 of the apparatus. The central bore of the sleeve 32 comprises an outer portion 36 of wider section for receiving, between the shoulder formed between the two bore portions of the sleeve 32 and the head 37 of the slide 33, a compression damping spring 38. The central bore of the sleeve 35 has a section corresponding to that of the anchors.

The anchors comprise a shank 39 with a head 40 and a pointed penetrating end 41. A centering washer 42 with the same outside diameter as the head 40 is slid over the shank 39.

The shuttle displacement rod 11 carries a lug 43 extending through an aperture 44 formed in one of the arms 45 of a rocker bar 46 with two arms 45, 47 pivotably mounted with respect to each other and forming a V-shaped configuration about a shaft 48 which is part of the anchor guide 7 and is orthogonal to the axis 20 of the apparatus and to the axis of the shuttle bore 23. The rocker bar 46 is linked to another rocker bar 49 of which the free end carries a displacement lug 50 extending through an aperture of the outer shuttle sleeve 32 and rigidly connected to the slide 33.

In summary, when the apparatus is used, the barrel holder 61 slides over the barrel 60, on the one hand to control closure of the combustion chamber 3 by covering the barrel 60 with the barrel holder 61, and on the other hand to control displacement of the shuttle 34 by movement of the finger 63 which moves the rod 11 which pivots the rocker bar 46 which in turn rotates the end of the rocker bar 49 linked thereto which moves the other end of the rocker bar 49 carrying the lug 50.

By so moving, the rod 11 lowers its lug 43 which is forced to slide in the aperture 44 of the arm 45 of the rocker bar 46, which forces the rocker bar 46 to pivot. As the firing cycles are executed, cooperation of the lug 43 with the edges of the aperture 44 and relative displacement of the rocker bars 46 and 49 can cause widening of this aperture and play in the rocker bars 46 and 49 which could limit rotation of the rocker bar 46 and therefore translation of the shuttle 34 if the invention had not been proposed.

In accordance with the present invention, the distance at rest between the finger 63 and the rod 11 is first determined so that actuation of the apparatus causes, apart from closing of the combustion chamber 3, sliding of the rod 11 over a length which, taking into account the arrangement and dimensions of the rocker bars 46, 49, the aperture 44, and the position of the lug 43 on the rod 11, should slide the shuttle 34 beyond its stop shoulder 25. Secondly, when the shuttle 34 comes into abutment with this shoulder 25, the continuation of descent of the rod 11 continues to actuate the kinetic chain of rocker bars which, by the lug 50, slides the slide 33 in the shuttle 34 against the action of the spring 38. The head 37 of the slide 33 is then returned inside the bore 36 of the shuttle sleeve 32. The supplementary structural travel of the shuttle 34, made impossible by the stop 25, is therefore absorbed by the slide 33 and its spring 38. This structure comprising the slide 33, the outer sleeve 32, the bore 36, and the spring 38 disposed within the bore 36 and interposed between the slide 33 and the outer sleeve 32, comprises, in effect, a lost-motion means or structural system whereby such supplementary travel, or overtravel, makes it possible to reduce wear of the components of the kinetic chain of displacement of the shuttle 34.

In reality, in the example considered, there are two quasi-identical kinetic chains of movement on either side of the apparatus, having the rod 11 in common.

An anchor having been loaded by gravity in the sleeve 35 of the shuttle 34 just before application of the apparatus upon the substrate and the shuttle 34 surely coming into abutment with the shoulder 25, the anchor at the end of application phase of the fastening operation is perfectly aligned with the bore portion 21 in the axis 20 of the apparatus. Under the action of the inertia block, it will be driven along this bore portion 21 in front of the shuttle 34, without catching on the rim 70 of this bore portion 21 and therefore being damaged.

It will be noted that, to keep the following anchor in the end piece 31 of the feed tube 8, without damaging it during sliding of the shuttle 34, the latter comprises a lateral ramp 71 for controlling positioning of the anchor.

Finally, in the shuttle 34, within a lower bore 72 thereof, there is provided an anchor retaining ball 73 subject to the action of a spring, not shown, to retain the anchor until it is driven on firing.

Obviously, many modifications and variations of the present invention are possible in light of the foregoing teachings. It is therefore to be understood that within the scope of the appended claims, the present invention may be practiced otherwise than as specifically described herein.

We claim:

1. Anchor fixing apparatus, comprising:

a combustion chamber housing an ignitable powder cartridge;

drive means, driven by combustion gases from said ignitable powder cartridge, for driving an anchor to be fixedly driven into a substrate;

an anchor shuttle movable between a first anchor loading position at which an anchor is loaded into said anchor shuttle, and a second anchor firing position at which an anchor is disposed so as to be driven into a substrate by said drive means;

means for moving said anchor shuttle between said first anchor loading position and said second anchor firing position; and lost-motion means operatively connected to said anchor shuttle moving means and said anchor shuttle for accommodating continued movement of said anchor shuttle moving means even after said anchor shuttle has been moved to said second anchor firing position so as to insure proper disposition of said anchor shuttle, and an anchor disposed therein, at said second anchor firing position regardless of the number of anchor firing cycles of said anchor fixing apparatus.

2. The apparatus as set forth in claim 1, wherein said means for moving said anchor shuttle comprises:

an anchor guide within which said anchor shuttle is movably mounted;

a shuttle displacement rod slidably mounted within said anchor guide between actuated and retracted positions; and rocker arm means operatively connected to said shuttle displacement rod and said anchor shuttle such that when said shuttle displacement rod is disposed at said retracted position, said rocker arm means disposes said anchor shuttle at said first anchor loading position, while when said shuttle displacement rod is disposed at said actuated position, said rocker arm means causes said anchor shuttle to be disposed at said second anchor firing position.

3. The apparatus as set forth in claim 2, further comprising:

spring means for biasing said-shuttle displacement rod toward said retracted position.

4. The apparatus as set forth in claim 2, wherein said rocker arm means comprises:

a first rocker arm having a substantially V-shaped configuration, pivotably mounted upon said anchor guide, and having a first end thereof pivotably connected to said shuttle displacement rod; and a second rocker arm having one end thereof pivotably connected to a second end of said first rocker arm, and another end thereof pivotably connected to said anchor shuttle.

5. The apparatus as set forth in claim 2, further comprising:

a bore, having a longitudinal axis, defined within said anchor guide for slidably housing said anchor shuttle between said first anchor loading position and said second anchor firing position;

said anchor shuttle comprises an outer sleeve member; and said lost-motion means comprises a displacement slide operatively connected to said rocker arm means and slidably disposed within said outer sleeve member of said anchor shuttle, and a damping spring interposed between said displacement slide and said outer sleeve member of said anchor shuttle.

6. The apparatus as set forth in claim 5, further comprising:

a second bore, having an axis disposed perpendicular to said longitudinal axis of said bore within which said anchor shuttle is slidably disposed, for accommodating an anchor when said an anchor is inserted into said anchor shuttle at said first anchor loading position.

7. The apparatus as set forth in claim 2, further comprising:

a barrel within which said combustion chamber is defined;

a barrel holder within which said barrel is relatively slidable, and which is movable toward and away from said substrate into which an anchor is to be fixedly driven; and a finger fixedly mounted upon said barrel holder for encountering said shuttle displacement rod of said anchor guide so as to move said shuttle displacement rod to said actuated position when said barrel holder is moved toward said substrate.

8. The apparatus as set forth in claim 2, further comprising:

a passageway defined within said anchor guide through which an anchor may pass for insertion into said anchor shuttle when said anchor shuttle is disposed at said first anchor loading position; and an anchor feed tube fixedly connected to said anchor guide and with respect to said passageway of said anchor guide for serially supplying a plurality of anchors to said passageway of said anchor guide for serial insertion within said anchor shuttle during cyclical operation of said anchor shuttle between said first anchor loading position and said second anchor firing position.

9. The apparatus as set forth in claim 5, wherein:

said bore for slidably housing said anchor shuttle comprises a shoulder portion for encountering an inner end portion of said anchor shuttle when said anchor shuttle is moved to said second anchor firing position so as to limit travel movement of said anchor shuttle from said first anchor loading position to said second anchor firing position and thereby define said second anchor firing position.

10. The apparatus as set forth in claim 8, wherein:

said anchor shuttle comprises an inclined ramp portion for encountering a leading one of a plurality of anchors disposed within said anchor feed tube and thereby separating a plurality of anchors disposed within said anchor feed tube from an anchor disposed within said anchor shuttle as said anchor shuttle is moved from said first anchor loading position to said second anchor firing position.

11. The apparatus as set forth in claim 1, wherein:

said apparatus comprises a powder-actuated tool.

12. The apparatus as set forth in claim 11, wherein said powder-actuated tool comprises:

an outer housing encasing said combustion chamber;

a pair of handles fixedly mounted upon said outer housing for enabling an operator to handle said tool; and a trigger mechanism mounted upon one of said pair of handles for initiating ignition of said ignitable powder cartridge.

13. Anchor fixing apparatus, comprising:

a combustion chamber housing a combustible fuel;

drive means, driven by combustion gases from said combustible fuel, for driving an anchor to be fixedly driven into a substrate;

an anchor shuttle movable between a first anchor loading position at which an anchor is loaded into said anchor shuttle, and a second anchor firing position at which an anchor is disposed so as to be driven into a substrate by said drive means;

means for moving said anchor shuttle between said first anchor loading position and said second anchor firing position; and lost-motion means operatively connected to said anchor shuttle moving means and said anchor shuttle for accommodating continued movement of said anchor shuttle moving means even after said anchor shuttle has been moved to said second anchor firing position so as to insure proper disposition of said anchor shuttle, and an anchor disposed therein, at said second anchor firing position regard-less of the number of anchor firing cycles of said anchor fixing apparatus.

14. The apparatus as set forth in claim 13, wherein said means for moving said anchor shuttle comprises:

an anchor guide within which said anchor shuttle is movably mounted;

a shuttle displacement rod slidably mounted within said anchor guide between actuated and retracted positions; and rocker arm means operatively connected to said shuttle displacement rod and said anchor shuttle such that when said shuttle displacement rod is disposed at said retracted position, said rocker arm means disposes said anchor shuttle at said first anchor loading position, while when said shuttle displacement rod is disposed at said actuated position, said rocker arm means causes said anchor shuttle to be disposed at said second anchor firing position.

15. The apparatus as set forth in claim 14, further comprising:

spring means for biasing said shuttle displacement rod toward said retracted position.

16. The apparatus as set forth in claim 14, wherein said rocker arm means comprises:

a first rocker arm having a substantially V-shaped configuration, pivotably mounted upon said rocker guide, and having a first end thereof pivotably connected to said shuttle displacement rod; and a second rocker arm having one end thereof pivotably connected to a second end of said first rocker arm, and another end thereof pivotably connected to said anchor shuttle.

17. The apparatus as set forth in claim 14, further comprising:

a bore, having a longitudinal axis, defined within said anchor guide for slidably housing said anchor shuttle between said first anchor loading position and said second anchor firing position;

said anchor shuttle comprises an outer sleeve member; and said lost-motion means comprises a displacement slide operatively connected to said rocker arm means and slidably disposed within said outer sleeve member of said anchor shuttle, and a damping spring interposed between said displacement slide and said outer sleeve member of said anchor shuttle.

18. The apparatus as set forth in claim 17, further comprising:

a second bore, having an axis disposed perpendicular to said longitudinal axis of said bore within which said anchor shuttle is slidably disposed, for accommodating an anchor when an anchor is inserted into said anchor shuttle at said first anchor loading position.

19. The apparatus as set forth in claim 14, further comprising:

a barrel within which said combustion chamber is defined;

a barrel holder within which said barrel is relatively slidable and which is movable toward and away from said substrate into which an anchor is to be fixedly driven;

a finger fixedly mounted upon said barrel holder for encountering said shuttle displacement rod of said anchor guide so as to move said shuttle displacement rod to said actuated position when said barrel holder is moved toward said substrate.

20. The apparatus as set forth in claim 17, wherein:

said bore for slidably housing said anchor shuttle comprises a shoulder portion for encountering an inner end portion of said anchor shuttle when said anchor shuttle is moved to said second anchor firing position so as to limit travel movement of said anchor shuttle from said first anchor loading position to said second anchor firing position and thereby define said second anchor firing position.

* * * * *